United States Patent [19]
Pohto
[11] 4,354,916
[45] Oct. 19, 1982

[54] HIGH CURRENT DENSITY ELECTRICAL CONTACT DEVICE

[75] Inventor: Gerald R. Pohto, Mentor, Ohio
[73] Assignee: Diamond Shamrock Corporation, Dallas, Tex.

[21] Appl. No.: 259,814
[22] Filed: May 4, 1981
[51] Int. Cl.[3] ..... C25B 9/04
[52] U.S. Cl. ..... 204/253; 204/267; 204/279
[58] Field of Search ..... 204/279, 253–258, 204/267–270, 194

[56] References Cited

U.S. PATENT DOCUMENTS

| | | | |
|---|---|---|---|
| 3,429,799 | 2/1969 | McWhorter | 204/279 |
| 3,453,198 | 7/1969 | Perabo | 204/279 |
| 3,788,966 | 1/1974 | Stephenson et al. | 204/256 |
| 3,824,173 | 7/1974 | Bouy et al. | 204/254 X |
| 3,859,197 | 1/1975 | Bouy et al. | 204/254 X |
| 3,915,833 | 10/1975 | Michalek et al. | 204/254 |
| 3,950,239 | 4/1976 | Figueras | 204/254 |
| 4,022,952 | 5/1977 | Fritts | 204/268 X |
| 4,026,782 | 5/1977 | Bouy et al. | 204/254 |
| 4,085,027 | 4/1978 | Pousch | 204/268 |
| 4,105,529 | 8/1978 | Pohto | 204/279 |
| 4,105,529 | 8/1978 | Pohto | 204/267 |
| 4,108,752 | 8/1978 | Pohto | 204/256 |
| 4,116,805 | 9/1978 | Ichisaka et al. | 204/268 X |
| 4,160,717 | 7/1979 | Navaro et al. | 204/279 |
| 4,224,132 | 9/1980 | Gernez | 204/279 |
| 4,308,125 | 12/1981 | Kaczur et al. | 204/279 |

FOREIGN PATENT DOCUMENTS

| | | | |
|---|---|---|---|
| 461153 | 4/1975 | U.S.S.R. | 204/279 |

OTHER PUBLICATIONS

"Style 913 SPIORTALLIC Gaskets", pp. 4 and 10.
"New Copper–Nickel–Tin Alloy Designed for Connectors", METAL PROGRESS, Nov. 1980, p. 15.
"SPIROTALLIC Gaskets"; three pages.
"GASKET COMPRESSION CHARACTERISTICS", four pages.
"COPPER FOR BUSBARS", pp. 79–82, 84, 86 and 89 of *Copper Development Association Publication*, No. 22, Reprint 1965.

*Primary Examiner*—Donald R. Valentine
*Attorney, Agent, or Firm*—John P. Hazzard

[57] ABSTRACT

The present invention is directed to fluid-tight, high current density-stable electrical contacts for conductively joining components of an electrolytic cell, e.g., anode and cathode plates, comprising a spring-like spiral or coil of electroconductive metal or metal alloy having an electrically conductive or nonconductive oxidation-resistant filler (seal) between the spiral rings and wherein said spiral rings are positioned so that their edges and common longitudinal axis are substantially perpendicular to the faces of the cell components.

12 Claims, 2 Drawing Figures

HIGH CURRENT DENSITY ELECTRICAL CONTACT DEVICE

BACKGROUND OF THE INVENTION

The present invention is directed to electrolytic cells and more particularly to electrolytic cells containing a bipolar type electrode wherein the electrical current is transferred from the anolyte element to the cathode element within the cell in a fluid-tight manner. Although the present invention is particularly directed to bipolar cells, it is also useful in other types of electrolytic cell as will be apparent to those skilled in the art.

This invention is particularly well-suited for use in joining components of an electrolytic cell, e.g., anode and cathode plates, in a fluid-tight cell. The electrolysis of ionizable chemical salts, e.g., alkali metal halides, to yield useful basic staple chemical products, e.g., alkali metal hydroxides, halogen and hydrogen has long been practiced commercially. For example, such electrolysis has been carried out in diaphragm cells wherein there are two compartments separated by a porous diaphragm. One compartment contains the cathode and the other contains the anode with the electrolyte flowing from the anode compartment through the porous diaphragm into the cathode compartment completing the electrical circuit. A variation of such a two compartment cell, called a filter press arrangement, is one wherein a large number of cells are connected in series in a common housing. According to such a variation, the anode of one cell is connected electrically with a cathode of an adjacent cell with these cells being separated by a barrier serving to prevent the passage of electrolyte between the adjacent cells. Such a configuration is termed a bipolar electrode, and the series of cells is called a bipolar type filter press cell.

The provision of efficient electrode connections between the anode and cathode elements are components of adjacent cell units is important. However, obtaining efficient electrical contacts which are both compact, liquid and gas tight and capable of ready removal for maintenance of the other components of the cell can be a troublsome and elusive goal, particularly where there is a high density current flow within the electrolytic cell. There have been many patents directed to provision of various fluid-tight electrical contacts and connections for electrolytic cells. U.S. Pat. No. 3,429,799 to R. W. McWhorter is directed to a fluid-tight electrical connector for connecting anode and cathode electrodes 20 and 42. The electrical connector comprises a flanged cylindar 32 with an axial bore 24 therein and the bore contains a soft metal filler material which can be integrally joined to electrode 20 as by welding.

U.S. Pat. No. 3,788,966 issued to C. W. Stephenson III et al discribes an electrical connection for metal electrodes formed by coating each connector part with a layer of softer but compatible, nonoxidizing metal and joining the connector parts together by exersion of a shearing stress as the male and female bolt connector parts are joined together during the bolting procedure.

U.S. Pat. No. 3,824,173 to P. Bouy et al shows a ring 5 which electrically connects an anode plate 6 and cathode 8. Ring 5 carries resilient plate members (not numbered) on its inner and outer surfaces, and these plates electrically interconnect parts 1 and 2. Parts 1 and 2 in turn are electrically connected to the anode and cathode plates. The annular surface of the ring makes the electrical contact as opposed to the end surfaces (edges) of the substantially concentric spirals or rings of the electrical contact device of this invention.

U.S. Pat. No. 3,859,197 to P. Bouy et al is directed to bipolar electrodes wherein the two electrically active parts are apertured, and the electrical connection between is made through the electrical contact formed within a plurality of bonded, e.g., welded members produced by plating a metal which can be used cathodically with a film-forming metal, and then using the bonded members as part of a sealing partition separating the two electrically parts.

U.S. Pat. No. 3,915,833 to S. A. Michalek et al discribes an electrical contact made between the mating surfaces of the anode and cathode bosses by coating a valve metal anode boss with platinum and the ferrous metal or a nickel cathode boss surface with a soft metal such as copper. A soft metal gasket is placed between the bolt head and the pressure receiving shoulder of the boss through which the bolt passes.

U.S. Pat. No. 3,950,239 issued to W. E. Figueras shows a bipolar plate having an electrical connector which comprises a rod 9 which extends between an anode plate 1 and cathode plate 3. This rod is threadibly secured within cylindar 5 and is electrically connected to caps 5 and 10 which, in turn, are electrically connected with the anode and cathode plates.

U.S. Pat. No. 4,022,952 issued to D. H. Fritts utilizes a porous metal matrix 21 to electrically interconnect metal grids 22 and 23 and therefore electrically connect cathode 24 with anode 25. The porous metal matrix is filled with a heat sink material.

U.S. Pat. No. 4,026,782 to P. Bouy et al utilizes an elastically deformable sealing member resting against a diaphragm and arranged in the recess of an adjacent frame. The elastically deformable member is arranged in a housing made in the recess and has a shape, e.g., toroidal, retangular, etc., which is adapted to the configuration of the sealing member.

U.S. Pat. No. 4,085,027 issued to K. A. Pousch describes a fastener assembly 16 comprising a bolt member 74 and nut member 80 which are electrically conductive thereby providing an electrical connection between an anode plate 12 and cathode 14.

U.S. Pat. No. 4,105,529 issued to Gerald R. Pohto (inventor herein) illustrates a helicoil electrical connector aligned between conductive bars so that the longitudinal axis of the connector is parallel to the bars. No filler seal material is employed.

U.S. Pat. No. 4,108,752 issued to G. R. Pohto illustrates the use of a variety of electrical connectors for electrically connecting bipolar plates. The electrical connector (C) can be of a variety of configurations, e.g., in the form of a conductive strip having louvers extending outwardly of the planar faces of the strip (C) in alternating pairs outwardly of one face (louvers 50) or the other (louvers 52) of the conductor strip. As can be seen from FIG. 6, louvers 52 establish contact between parallel surfaces abutting thereto. FIG. 7 illustrates an undulate configuration for conductor strip (C) whereas FIG. 8 shows an askew helix-shaped electrical connector which is aligned between the plates so that its longitudinal axis is parallel to the face of the plates. This is in contrast to the contact device of the present invention wherein the longitudinal axis of the spiral (and the edges thereof) are perpendicular to the face of the electrode plate.

U.S. Pat. No. 4,116,805 issued to Ichisaka et al illustrates bipolar plates 2 and 3 electrically connected by a pin 19.

Also there is currently available on the market a gasket which applicant has utilized in the present invention to form an electrical contact. This gasket is marketed under the trade designation "SPIROTALLIC" and "FLEXITALLIC" and is of the spiral-wound type having a variety of filler materials, such as asbestos, PTFE (polytetrafluoroethylene) of both the solid and nonsintered variety. The "FLEXITALLIC" and "SPIROTALLIC" gaskets are advocated for use as a gasketing material in aircraft, diesel, gas and rocket engines; boiler feed, centrifugal, condensate, reciprocating and vacuum pumps; gauge and sight glasses; centrifugal and reciprocating compressors; high pressure and soot blowers; hydraulic and molding presses; gas and steam turbines; heat exchangers; high voltage power transformers; and all types of valves. In general, these gaskets are described as suitable for use in nonstandard joints and piping systems and pressure vessels.

Applicant has surprisingly discovered that these gasket materials of the spiral-wound spring variety are highly useful as fluid and air tight, electrical contact devices for conductively joining electrolytic cell anode and cathode plates particularly wherein there is a high current density electrolysis being conducted in such cells.

BRIEF SUMMARY OF THE INVENTION

The present invention is directed to fluid-tight, high current density-stable electrical contacts for conductively joining components of an electrolytic cell, e.g., anode and cathode plates, comprising a spring-like spiral or coil of electroconductive metal or metal alloy having an electrically conductive or nonconductive oxidation-resistant filler (seal) between the spiral rings and wherein said spiral rings are positioned so that their edges and common longitudinal axis are substantially perpendicular to the faces of the cell components. It has been determined that the aforementioned electrical contact provides extremely low voltage loss during operation and adjustment for flatness tolerances due to its acting as a spring contact between two plates such as are employed in a bipolar cell. Additionally the present invention provides a contact junction which does not degrade due to overheating and oxidation, such as does occur utilizing aluminum busbars. The present invention provides an improved junction for aluminum surfaces which normally tend to degrade due to formation of aluminum oxide. Moreover, the contact device of this invention provides a high load (amperage) junction which can be easily disassembled for anode recoating or other maintenance. The present invention has the ability to carry higher current densities than traditional flat plate junctions or lighter spring contacts and offers economy of space and material in addition to being a contact device which is comparatively simple to fabricate. It has also been observed that the contact device of this invention is self-protecting from corrosion in as much as its sharp, knife edges offer intimate contact with the electrode sheets thus preventing oxidation while at the same time transmitting electrical contact with continuous electrical transfer. It should be observed that the contact devices of this invention can be fabricated to any desired spring constant, current load and deflection range which is desired by modifying the gauge of the coil or spiral, the number of coils present, the height, the spiral diameter, the bend, the material, or the heat treatment employed as well as many other parameters to suit the connection size desired. Additionally, the present invention offers a junction device which can be used in place of bimetal plates (explosion bonded) in as much as the latter are exposed to atomic hydrogen and frequently separate because of molecular hydrogen build-up at the interface.

DETAILED DESCRIPTION OF THE INVENTION

Figure 1:
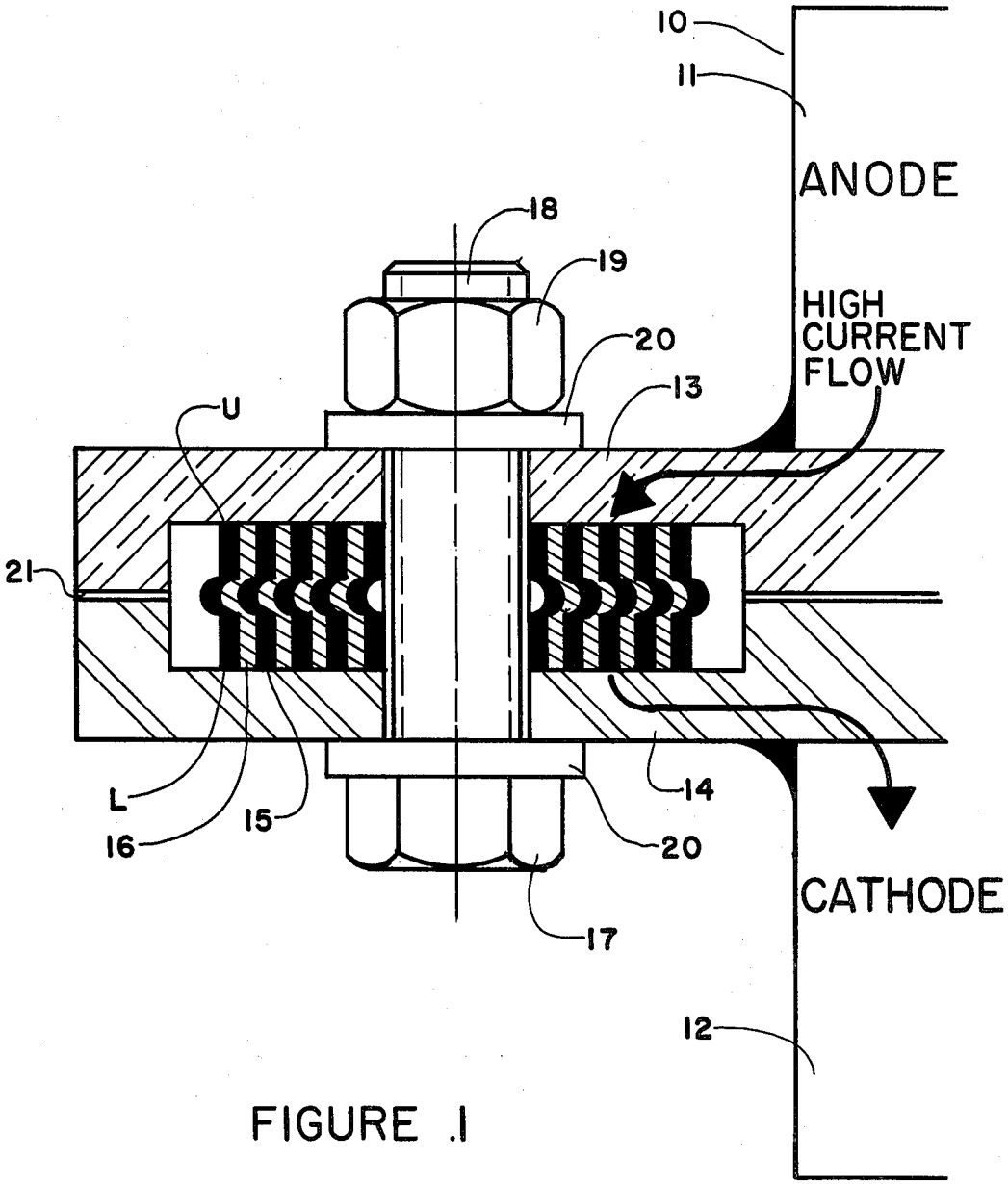
Figure 2:
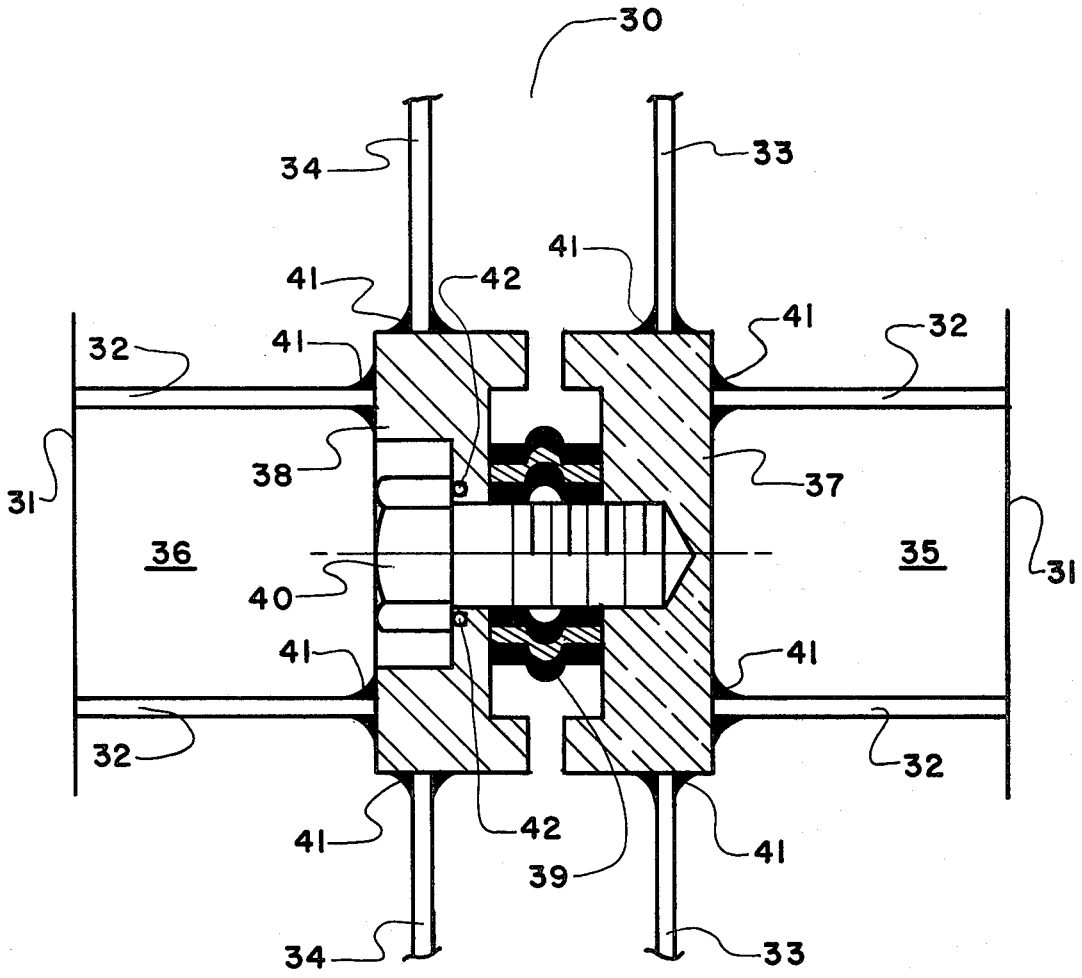

The invention will be illustrated further in conjunction with the accompanying drawings in which FIG. 1 is a cross-sectional view showing the contact device of this invention in place serving as an electroconductive contact in an electrolytic cell, and FIG. 2 is a cross-sectional view illustrating the contact device used in a boss-to-boss contact in a bipolar membrane cell.

According to FIG. 1, electrolytic cell 10 is comprised of major components being an anode 13 located in anode compartment 11 and cathode 14 located in corresponding cathode compartment 12. The electrical contact device of this invention is comprised of a spring-like spiral or coil comprised of spirals 15 having a nonconductive, oxidation-resistant filler or seal material 16 positioned between the respective spirals or coils 15. The upper edges U and lower edges L of the respective spirals 15 contact the lower portion of the anode plate 13 and the upper portion of the cathode plate 14, respectively. Bolt or screw 17 can be employed by inserting it through the appropriate opening in both the anode and cathode plates and serves to press the anode and cathode plates inner surfaces against the upper and lower edge surfaces of the contact device of this invention. Washers 20 can be used in conjunction with nut 19 to effect this pressure which can assist bringing the aforementioned upper and lower edges, U and L, of the contact device in contact with the lower surfaces of the anode 13 and the upper edge surfaces of the cathode plates 14 respectively. Hydrogen vents 21 can be provided.

In accordance with FIG. 2, the spiral contact device of this invention 39 is used for establishing boss-to-boss electrical contact assembly in a bipolar membrane cell. Boss-to-boss contact assembly 30 is located between adjacent cell membranes 31, e.g., made of "NAFION" marketed by DuPont. Flat stand-off bars 32 are welded to the anode e.g., titanium, boss 37 and the cathode, e.g., stainless steel, boss 38 at weldments 41. Similar weldments 41 respectively join the anode boss 37 to anode compartment wall sections 33 and the cathode boss 38 to cathode compartment wall sections 34. Assembly 30 is thus positioned partially in and between anolyte compartment 35 and catholyte compartment 36. The spiral contact device of this invention 39 is securely held between and in contact with the anode boss 37 and cathode boss 38 by high strength, caustic resistant stainless steel or nickel bolt 40. O-ring 42 which can be made of rubber, e.g., "BUNA-N" or elastomer material, e.g., "EPDM" (a polymer of ethylene-propylene diene monomer) completes the assembly.

The copper spiral 15 employed in accordance with this invention can be fabricated from a variety of electrically-conductive materials. Suitable materials for this purpose include, but are not necessarily limited to: copper and copper alloys, such as, beryllium-copper; copper-nickel-tin, e.g., "spinodal 770" (77 Cu-15Ni- 88SNn); phosphor-bronze; brass; aluminum alloys; monel; copper-plated spring steel; copper and other metal laminates; roll-bonded layers, and other equivalent materials.

The filler or seal material 16 which is employed between the various spirals of the contact device of this invention can be made of any nonconductive or conductive, oxidation-resistant material. Suitable nonconductive, oxidation resistant filler (seal) materials which can be used include, but are not necessarily limited to, the following: polytetrafluoroethylene in powder form or with or without chopped glass fibers as in a powder/-glass fiber matrix; polytetrafluoroethylene in fibrous form (fibrillated or unfibrillated); chopped asbestos; aramide polymers, e.g., the aromatic polyamid polymer marketed by the duPont de Nemours & Company under the trade designation "Kevlar," either in fibrous or nonfibrous form and whether fibrillated or not, e.g., in the form of powder or fibrous matrices containing such aramide polymer material; polyvinyl chloride polymers; fiberglass; etc. In some circumstances, it may be desirable to utilize filler (seal) material which is partially or comparatively fully electroconductive. For this purpose, carbon fibers can be utilized, e.g., graphite fibers. In general, fibers and/or fibrous-containing composites can be used, e.g., "Grafoil"; silver-plated copper strands; nickel fibers; stainless steel fiber wool; etc.

It has been recognized for many years that successful mechanical junction of two electrical components requires the ability to maintain a continuous and high contact pressure and not necessarily over a large area of contact. Various types of springs have been used to maintain this pressure. For example, a standard coil compression spring is often used to press two flat contacts together. Similarly a cantilever spring is used to both carry the current and create the pressure at its tip.

The merit to the spiral spring utilized according to this invention is its ability to maintain unusually high loads with a very small deflection range. Also as the deflection changes (as to adjust itself for temperature expansion), the magnitude of the load does not vary significantly. In other words, it has a flat curve plotting load (pounds) versus deflection. It is the maintenance of this edge load on the spring in accordance with this invention that prevents oxidation, and therefore prevents a voltage build-up due to increase in ohmic resistance of the joint.

In accordance with this invention, the filler material is used to both support the parallel (or concentric) coils of the spiral and to exclude any corrosion materials as well as air (oxygen). It is clear that advanced oxidation cannot occur if oxygen is excluded from the contact.

The filler material employed herein must have good hydraulic compression characteristics such as possessed by elastomers, rubber, etc., e.g., EPDM (ethylene-propylene diene rubber), neoprene, BUNA-N, etc. It must not, however, break down under a high compression load because the oil or gas given off, due to breaking down, might react with the copper. It also must have reasonable temperature resistance. For some contact devices, a filler (seal) containing or comprised of a material selected from the group consisting of rubber, elastomers and polytetrafluoroethylene is preferred. Other suitable filler materials include, but are not necessarily limited to, the following: blue-dyed Canadian asbestos paper; white-dyed Canadian asbestos paper; white-dyed Canadian asbestos paper with an inorganic binder or a rubber, e.g., "BUNA-N" PTFE (polytetrafluoroethylene); or Neoprene binder; glass-filled PTFE; "Grafoil", viz., a commercially available compressed graphite matrix paper marketed by the Union Carbide Corporation, etc.

I claim:

1. A fluid and air tight, high current density-stable, electrical contact device for conductively joining components of an electrolytic cell comprising a spring-like spiral or coil of electroconductive metal or metal alloy having a nonconductive or conductive, oxidation-resistant filler (seal) between the spiral rings of the contact and wherein said spiral is positioned so that the edges and common longitudinal axis thereof are substantially perpendicular to the faces of the cell components to be electrically contacted.

2. An electrolytic cell containing contact devices in accordance with claim 1.

3. A contact device as in claim 1 wherein said spring-like spiral or coil is copper.

4. A contact device as in claim 1 wherein said filler (seal) is electrically conductive.

5. A contact device as in claim 1 wherein said filler (seal) is electrically nonconductive.

6. A contact device as in claim 5 wherein said filler (seal) comprises polytetrafluoroethylene.

7. A contact device as in claim 5 wherein said filler (seal) comprises an aramide polymer.

8. A contact device as in claim 1 wherein said filler (seal) comprises asbestos.

9. A contact device as in claim 1 wherein said filler (seal) comprises fibers and a binder.

10. A contact device as in claim 9 wherein said fibers comprise asbestos.

11. A contact device as in claim 1 wherein said filler (seal) comprises a compressed graphite matrix.

12. A contact device as in claim 1 wherein said filler (seal) contains a material selected from the group consisting of rubber, elastomers and polytetrafluoroethylene.

* * * * *

UNITED STATES PATENT AND TRADEMARK OFFICE

CERTIFICATE OF CORRECTION

PATENT NO. : 4,354,916

DATED : October 19, 1982

INVENTOR(S) : Gerald R. Pohto

It is certified that error appears in the above-identified patent and that said Letters Patent are hereby corrected as shown below:

In column 2, line 68, the word "plate" should be --plates--

In column 5, line 1, the designation "88SNn" should be --88Sn--

Signed and Sealed this

*First* Day of *February 1983*

[SEAL]

*Attest:*

GERALD J. MOSSINGHOFF

*Attesting Officer* *Commissioner of Patents and Trademarks*